US008543244B2

(12) United States Patent
Keeling et al.

(10) Patent No.: US 8,543,244 B2
(45) Date of Patent: Sep. 24, 2013

(54) HEATING AND COOLING CONTROL METHODS AND SYSTEMS

(76) Inventors: Oliver Joe Keeling, Ames, IA (US); Peter Lewis Keeling, Ames, IA (US)

( * ) Notice: Subject to any disclaimer, the term of this patent is extended or adjusted under 35 U.S.C. 154(b) by 702 days.

(21) Appl. No.: 12/641,487

(22) Filed: Dec. 18, 2009

(65) Prior Publication Data

US 2010/0211224 A1 Aug. 19, 2010

Related U.S. Application Data

(60) Provisional application No. 61/139,327, filed on Dec. 19, 2008.

(51) Int. Cl.
*G05D 23/19* (2006.01)

(52) U.S. Cl.
USPC ..... 700/276; 700/288; 700/291; 700/295; 700/287; 700/297

(58) Field of Classification Search
None
See application file for complete search history.

(56) References Cited

U.S. PATENT DOCUMENTS 4,136,732 A * 1/1979 Demaray et al. ..... 165/216
4,841,733 A * 6/1989 Dussault et al. ..... 62/93
5,024,263 A * 6/1991 Laine et al. ..... 165/283
5,065,585 A * 11/1991 Wylie et al. ..... 62/89
5,082,173 A * 1/1992 Poehlman et al. ..... 236/11
5,230,466 A * 7/1993 Moriya et al. ..... 236/44 A
5,239,834 A * 8/1993 Travers ..... 62/151
5,259,553 A * 11/1993 Shyu ..... 236/49.3
5,746,653 A 5/1998 Palmer et al.
5,761,083 A 6/1998 Brown et al.
5,902,183 A * 5/1999 D'Souza ..... 454/258
6,095,426 A 8/2000 Ahmed et al.
6,318,096 B1 * 11/2001 Gross et al. ..... 62/122
6,756,998 B1 6/2004 Bilger
6,766,651 B2 7/2004 Dillenback
6,912,429 B1 6/2005 Bilger
7,044,397 B2 5/2006 Bartlett et al.
7,231,967 B2 * 6/2007 Haglid ..... 165/231
7,343,226 B2 3/2008 Ehlers et al.
7,398,821 B2 * 7/2008 Rainer et al. ..... 165/247
7,434,742 B2 10/2008 Mueller et al.
7,497,774 B2 * 3/2009 Stevenson et al. ..... 454/354
7,758,408 B2 * 7/2010 Hagentoft ..... 454/256
7,798,418 B1 * 9/2010 Rudd ..... 236/49.3
7,891,573 B2 * 2/2011 Finkam et al. ..... 236/49.3
7,894,943 B2 * 2/2011 Sloup et al. ..... 700/276
8,079,898 B1 * 12/2011 Stevenson ..... 454/328
8,118,236 B2 * 2/2012 Lestage et al. ..... 236/44 C (Continued)

*Primary Examiner* — Kavita Padmanabhan
*Assistant Examiner* — Christopher E Everett

(57) ABSTRACT

A single controller interface (Smart-Stat) integrates the control of heating or cooling in buildings by simultaneously controlling Heating, Ventilation and Air Conditioning (HVAC) systems in concert with separate fresh air ventilation (FAV) systems. The Smart-Stat reduces costs and the carbon footprint of typical HVAC systems by optimizing the use of FAV. User-programmable set-points are incorporated with time-of-day and day-of-week as well as data from multiple sensors, thermostats and weather information. Mathematical algorithms are used to determine control signals to the HVAC or FAV systems. The Smart-Stat integrates the two separate systems into a single system that is able to direct the call for cooling or heating to the HVAC or FAV systems, depending on appropriate outside weather conditions. Any building can replace its existing HVAC system controller with the Smart-Stat controller and incorporate a FAV system to create a single integrated HVAC and FAV system.

10 Claims, 10 Drawing Sheets

(56) References Cited

U.S. PATENT DOCUMENTS

| | | | | |
|---|---|---|---|---|
| 2003/0216837 | A1* | 11/2003 | Reich et al. | 700/276 |
| 2004/0173690 | A1* | 9/2004 | Takusagawa | 236/51 |
| 2007/0043477 | A1* | 2/2007 | Ehlers et al. | 700/276 |
| 2007/0057078 | A1* | 3/2007 | Martin | 236/49.3 |
| 2007/0205294 | A1* | 9/2007 | Byczynski et al. | 236/44 C |
| 2008/0014857 | A1* | 1/2008 | Spadafora et al. | 454/229 |
| 2009/0001179 | A1 | 1/2009 | Dempsey | |
| 2009/0050703 | A1 | 2/2009 | Lifson et al. | |
| 2009/0240381 | A1* | 9/2009 | Lane | 700/296 |
| 2010/0006661 | A1* | 1/2010 | Goodwin et al. | 236/44 A |
| 2010/0048123 | A1* | 2/2010 | O'Gorman | 454/212 |
| 2010/0057258 | A1* | 3/2010 | Clanin | 700/276 |
| 2010/0070093 | A1* | 3/2010 | Harrod et al. | 700/278 |
| 2011/0151766 | A1* | 6/2011 | Sherman et al. | 454/239 |

* cited by examiner

LEGEND: --Prior Art--

LEGEND: --Prior Art--

LEGEND: --Prior Art--

HEATING AND COOLING CONTROL METHODS AND SYSTEMS

This is a continuation of Provisional Patent Application U.S. 61/139,327 filed Dec 19, 2008.

FIELD OF THE INVENTION

The presently claimed invention is related to the field of heating, ventilation and air conditioning (HVAC). More particularly, the presently claimed invention is related to methods and systems for controlled heating and cooling in order to reduce costs and the carbon footprint of said heating and cooling by optimizing the use of fresh air ventilation (FAV).

BACKGROUND OF THE INVENTION

Heating, ventilating, and air conditioning (HVAC), sometimes referred to as climate control, involves closely regulating humidity and temperature in order to maintain a comfortable, safe and healthy environment inside a building. HVAC has been described in detail in "Simplified design of HVAC systems" (William Bobenhausen—1994—Technology & Engineering). HVAC system settings are controlled by a thermostat inside a building and typically include a controller device that adjusts the temperature settings for different times of day and different days of the week. The controller device acts as a programmable interface with users of the building. Over many years there have been many improvements in the components of HVAC systems including higher efficiency systems and improved system controllers. The American Society of Heating, Refrigerating and Air-Conditioning Engineers (ASHRAE) fulfills its mission of advancing HVAC and refrigeration to serve humanity and promote a sustainable world through research, standards writing, publishing and continuing education. ASHRAE have suggested standards (e.g., ASHRAE Standard 62.2) for ventilation and acceptable indoor air quality that requires fresh air to be ventilated into a house or building to at least a minimum level. To provide an informative background of information, ASHRAE Standard 62.2 and other information about HVAC provided by ASHRAE are hereby incorporated by reference.

Existing HVAC systems are shown in FIG. 1 which provides a schematic of a building that includes an HVAC system that includes heating and cooling devices, heat exchangers, fans, ductwork and dampers. Said system is controlled by a controller designed to determine switch-point on/off settings for elements of the HVAC system. The controller achieves a comfortable indoor setting by determining timing of switch points during continuous monitoring the indoor environment from one or multiple sensors that includes for example thermostats and humidistats. One significant drawback with such HVAC systems is that they do not comply with ASHRAE Standard 62.2 because they typically do not provide any outside ventilation capability.

In recent years as a result of improvements in building engineering, fresh air impact has declined as buildings have become more airtight. Fewer drafts means improved heating and cooling efficiency. Importantly it has also meant that indoor air can be stale and some would argue not so healthful. To that end improvements in HVAC have been sought that involve finding ways to sample outside air to provide ventilation. Some solutions use heat-exchangers to conserve the energy in a building. Improved HVAC systems are shown in FIG. 2 which provides a schematic of a building that includes an HVAC system similar to that shown in FIG. 1 but with the additional capability of fresh air ventilation using a selectively operable damper and fan. This type of system is present in some modern HVAC systems (e.g., Aprilaire Model 8126 Ventilation Control System, or Honeywell Fresh Air Ventilation System Power-Open Spring-Closed Damper & W8150A Control) and is also controlled by a controller. Such controllers typically prevent the system from sampling outside air when temperatures are below or above a certain limit. One significant drawback with currently available ventilation with HVAC is too little fresh air ventilation or random timing of control of fresh-air sampling that causes poor energy efficiency in the HVAC system. Some improvements, such as U.S. Pat. No. 7,044,397, are designed to improve fresh air ventilation have been made by determining a fraction of time that the fresh air intake must be open during anticipated future system calls of the HVAC system to meet a desired ventilation threshold. Another improvement such as U.S. Pat. No. 6,095,426 involves feedback and feedforward control strategies and a method of controlling such apparatus for improved performance. Whilst these improvements in ventilation capability are built into the HVAC system their control is notably not integrated with the HVAC controller.

Existing literature clearly demonstrates that using outside ventilation as part of a mixed-mode cooling system can reduce building operating costs and carbon emissions (e.g., see ASHRAE Transactions: 2006; 112: 281-3571). Typically such cooling methods are built on individual trial and error principles and do not rely on optimized mathematical algorithms that account for outside conditions and inside occupant comfort. Such buildings are often controlled by individual occupants opening windows and doors to permit outside ventilation. Whilst this approach is very effective it does not adapt quickly to outside conditions and does not function without active occupant participation and is not inherently optimized to minimize costs. There is clearly a need for a more adaptive automated approach that might be integrated with existing HVAC capability. A recent publication by Spindler and Norford (2008) describes controlling algorithms for mixed-mode cooling strategies including use of natural ventilation (Naturally ventilated and mixed-mode buildings—Part I: Thermal modeling. Building and Environment, in press (doi: 10.1016/j.buildenv.2008.05.019)). A second publication by Spindler and Norford describes ways to optimize the controlling algorithms for mixed mode cooling (Naturally ventilated and mixed-mode buildings—Part II: Optimal control. Building and Environment In Press, (doi: 10.1016/j.buildenv.2008.05.018)). Important overall conclusions from these studies are that HVAC control algorithms can be built using linear thermal modeling and can be optimized for use in buildings. What is apparent from the literature as well as in fact from a review of existing HVAC control equipment, is the surprising lack of automated integration of mixed-mode heating and cooling using a combination of ventilation and HVAC.

The presently claimed invention (referred to hereinafter as a "Smart Stat Controller" or "Smart Thermostat" or alternatively "Smart-Stat") overcomes the random timing and inefficient use of fresh air ventilation by incorporating a novel control system. FIG. 3 provides a schematic of a building that includes an HVAC system similar to that shown in FIG. 2 but with the additional capability of incorporating the present invention. FIG. 4 provides a schematic of a typical controller, whilst FIG. 5 provides a schematic of the present invention's programmable controller or smart thermostat (Smart-Stat). FIG. 6 provides a second schematic of the present invention's programmable controller configured with an existing typical thermostatic controller. The Smart Thermostat system is designed to optimize the timing of use of fresh air based on current outside conditions in combination with data from weather forecasts. Specifically the Smart Thermostat controller controls air-flow and HVAC in buildings by using mathematical algorithms that monitors regional weather forecasts in combination with current outside air monitoring. The present invention saves energy and reduces the carbon footprint of heating and cooling by achieving optimal timing of HVAC combined with use of ambient air ventilation as an alternative to heating and cooling. In short, the Smart-Stat controller uses outside ventilation to achieve the desired result of providing a comfortable inside air temperature and quality against user-programmable set-points.

Previously described improvements in HVAC utilize counter-flow systems that radiate heat from incoming and outgoing air. In addition, some of the said improved HVAC systems include temperature sensors for the inside and outside air that are used to set dampers flow rate in order to conserve energy. Thus it can be envisioned one aspect of the concept of the present Smart-Stat invention can be seen within these improvements to HVAC. Specifically, the existing HVAC improvements include monitoring inside and outside temperatures in order to control energy flow between incoming and outgoing air. Some of these systems integrate this control with weather information but importantly, the improved indoor ventilation is only a fraction of the air flow. Furthermore, unlike the present invention, the improved HVAC systems sample outside air with the purpose of improved air quality and the outside air is heated or cooled in just the same way as indoor air, all under the control of a typical thermostatic controller. Importantly the present invention uses the existing HVAC system to circulate air and bring-in outside air to over-ride the use of heating and cooling as used in the typical thermostat controller and improved HVAC systems. Specifically in none of the HVAC improvements is there a system for using the outside air as an alternative source of heating or cooling with the specific goal of reducing costs and reducing the carbon footprint of HVAC systems.

Another existing technology that shares similarities with the present invention is the use of whole house ventilation fans or window fans to cool or warm a house using outside air. Here, the purpose is similar to that described by the present invention: namely energy saving using outside air. Sometimes called "Whole House Ventilation" or "Whole House Fans", these systems provide a fan often mounted in the ceiling that vents air into the attic where the air is lost passively or expelled using another fan in the roof space. These systems are often controlled using a switch, activated by a user and requires that said user has opened windows within the home. Sometimes the fans are activated by the user and rely upon opened wall ventilation panels to allow balanced air flow. Sometimes the fans are activated by temperature sensors. Importantly, in none of these examples is there an attempt to integrate or automate the Whole House Ventilation with an existing HVAC nor is there any integration with the buildings HVAC Control system or control software. Thus the user has to switch them on manually and manually switch off the HVAC system. More importantly the Whole House System does not bring together a monitoring system for inside and outside conditions with time and additionally does not integrate this with weather data monitoring to predict an optimal use of outside air. Thus the present invention overcomes the limitations of the existing systems of HVAC by bringing together such data into logical algorithms that make optimal automated use of outside weather conditions. Initially we modeled the cost saving potential using spreadsheets based on actual temperature data downloaded from the Iowa State University μg Climate 2005, 2006, 2007—Iowa Environmental Mesonet. Significant annual cost savings were possible during certain months (April through October) when temperatures were not extreme.

Yet another existing technology that shares similarities with the present invention is the use of on-line weather data to monitor local weather forecasts and take proactive steps in system operation and control. Here, the purpose is similar to that described by the present invention: namely using weather forecasting information to make decisions on controlling the HVAC system. However, the present invention uses the weather information to call on outside ventilation in place of HVAC, whereas the existing technologies proactively change the HVAC settings in days preceding weather events by increasing or decreasing cooling or heating in order to place less demand on the system on the day of the weather event. Thus the present invention overcomes the limitations of the existing technological advances in systems of HVAC control by bringing together such data into logical algorithms that monitors outside weather conditions and terminates calls for HVAC, redirecting this into calls for fresh air ventilation by reacting to outside weather conditions.

Smart-Stat can be linked with home computer monitoring and control systems and computer software systems by using any kind of suitable interface. For example, industry-standard RS-232/RS-485 protocol, or X10-Control or Z-Wave control. X10 is an international and open industry standard for communication among electronic devices used for home automation, also known as domotics. X10 primarily uses power line wiring for signaling and control, where the signals involve brief radio frequency bursts representing digital information. A wireless radio based protocol transport can also be also defined. Z-Wave is a wireless communications standard designed for home automation, such as remote control applications in residential and light commercial environments.

Smart-Stat uses the National Digital Forecast Database (NDFD) Extensible Markup Language (XML) as a service, accessing local weather data from the National Weather Service's (NWS) digital forecast database. This service, which is defined in a Service Description Document, provides the ability to request NDFD data over the internet and receive the information back in an XML format. The request/response process is made possible by the NDFD XML Simple Object Access Protocol (SOAP) server. The first step to using the web service is to create a SOAP client. The client creates and sends the SOAP request to the server. The request sent by the client then invokes one of the server functions. There are currently nine functions available including: NDFDgen(), NDFDgenLatLonList(), LatLonListSubgrid(), LatLonListLine(), LatLonListZipCode(), LatLonListSquare(), CornerPoints(), NDFDgenByDay(), and NDFDgenByDayLatLonList(). Said weather data will include a time-based forecast of temperature and relative humidity as well as hours of sunshine or cloud-cover. Upon receiving said weather data, the present invention monitors local weather forecasts for the coming days ahead and integrates this information with current inside and outside temperatures. Computational algorithms based on the local forecasts and local data are then used by Smart-Stat to make logical choices that control the HVAC system and determine appropriate use of fresh air ventilation. The system is designed not to operate ventilation if the outside air is below 40° F. or above 100° F. and if the relative humidity is above 60%.

The present invention is also able to use its outside/inside/weather monitoring capability to compute models of heat-loss and heat-gain for the local building in which it is placed. Such models represent coefficients of heat loss/gain in different environmental conditions and enable more sophisticated algorithms to be computed that will improve the ability of the control system to determine optimal set-points for the HVAC system and determine optimal use of fresh air ventilation. Thus the system learns over time and adjusts set-points accordingly. Another aspect of this monitoring system is its ability to output heat-transfer information to the local user as well as local service/installation companies. Such data output would allow the local users to recognize differences between houses in terms of heat transfer, and enable a data-driven recommendation for improvements in building insulation. The outcome would be improvements in the overall energy consumption of buildings in relation to heating and cooling requirements. Such improvements would have an impact on local and regional carbon footprints regarding energy utilization.

In light of these developments in the art, a number of patent and other documents are referenced herein which relate to efforts to modify HVAC and to achieve improvements in energy efficiency. These documents are hereby incorporated by reference.

Thus, for example U.S. Pat. No. 7,044,397 describes improved fresh air ventilation by determining a fraction of time that the fresh air intake must be open during anticipated future system calls of the HVAC system to meet a desired ventilation threshold. Another improvement such as U.S. Pat. No. 6,095,426 describes feedback and feedforward control strategies and a method of controlling such apparatus for improved performance.

U.S. Pat. No. 5,746,653 describes an apparatus mounted in for example an attic that can distribute and collect air where a fan draws air from a perforated elongated tube and vents the air as needed in order to provide cooling or heating in a building.

U.S. Pat. No. 5,761,083 describes an Energy Management and Home Automation system that senses the mode of occupancy of the building. Thus control is different when occupied or unoccupied and heating and cooling based is switched appropriately.

U.S. Pat. No. 6,095,426 involves feedback and feedforward control strategies and a method of controlling such apparatus for improved performance.

U.S. Pat. Nos. 6,756,998 and 6,912,429 detects building occupancy status using motion sensor devices interfaced with the controller unit. The system even learns from data inputs and builds an occupancy pattern for each room.

U.S. Pat. No. 6,766,651 describes use of humidity control and aromas and even pesticidal, bacteriacidal, fungicidal or sporacidal agents can be introduced into the airflow to enhance HVAC.

U.S. Pat. No. 7,044,397 describes use of fresh air ventilation wherein a fraction of time is determined for fresh air intake opening during anticipated future system calls of the HVAC system to meet a desired ventilation threshold.

U.S. Pat. No. 7,343,226 describes a system and method of controlling an HVAC system that incorporates outside temperature monitoring and is linked to demand and consumption rate from the distribution network.

U.S. Pat. No. 7,434,742 describes a thermostat having a microprocessor and network interface to obtain user-specified information from a remote service provider plus a display device responsive to the microprocessor for displaying user-specified information received via the network controller from the remote service provider.

Patent WO/2007/094774 describes a method and apparatus for maintaining an acceptable level of outside air exchange rate in a structure. The natural ventilation rate is determined as a function of the outdoor air temperature, and the amount of mechanically induced ventilation that is used to supplement the natural air ventilation is controlled such that the sum of the natural occurring ventilation and the mechanically induced ventilation is maintained by a substantially constant predetermined level.

Patent WO/2007/117245 describes a controller for an HVAC & R system is provided with the Internet connection to weather forecast information in order to determine proactive steps that increase heating or decrease cooling, or alternatively decrease heating or increase cooling, prior to changes in weather beginning to occur. The patent also describes using the proactive monitoring system to control fresh air circulation rate.

HVAC engineers continue to research ways to optimize the operation of heating and cooling systems, however despite various publications, practical applications are not apparent. For example, although Zaheer-uddin and Zheng describe optimal control of HVAC (Energy Conversion and Management (2000) 41, 49-60), whilst Chen describes adaptive predictive control for heating applications (Energy and Buildings (2002) 34, 45-51) and more recently, He, Cai and Li describe use of multiple fuzzy model-based temperature predictive control systems (Information Sciences (2005) 169, 155-174) none of these publications describe practical examples of improved control systems.

As can be seen from the foregoing review of the art, there is intense interest in improving HVAC and its impact on energy utilization and carbon footprint. There exist problems in various aspects of the known technologies, from using more efficient heat exchangers to improved monitoring and the like. Accordingly, there remains a need in the art for novel methods and compositions which provide improvements in energy utilization and carbon footprint control. The present invention provides a valuable additional set of novel methods and control systems which meet these needs while placing a minimal burden on HVAC systems needing modification according to this technology.

SUMMARY OF THE INVENTION

A primary object of the present invention is to provide a user-programmable controller having mathematical algorithms that monitors and reacts to local current ambient air conditions in order to provide logical control signals that will control the use of whole house ventilation as an alternative to HVAC in a whole-building heating and cooling system for improved energy efficiency.

Another primary object of the present invention is to provide a user-programmable controller having mathematical algorithms that monitors and reacts to local weather forecasts, current ambient air conditions in order to provide logical control signals that will control the use of whole house ventilation as an alternative to HVAC in a whole-building heating and cooling system for improved energy efficiency.

Another embodiment of the present invention is to provide a user-programmable controller having mathematical algorithms that monitors and reacts to local weather forecasts, current ambient air conditions in order to provide logical control signals that will optimize the use of fresh air ventilation in combination with heating and cooling cycles in a whole-building heating and cooling system for improved energy efficiency.

And another embodiment of the present invention is to provide a user-programmable controller having mathematical algorithms that monitors and reacts to local weather forecasts and current ambient air conditions and models of building heat retention and loss in order to provide logical control signals that will optimize the use of fresh air ventilation in combination with heating and cooling cycles in a whole-building heating and cooling system for improved energy efficiency.

Yet another embodiment of the present invention is to provide a user-programmable controller having mathematical algorithms that monitors and reacts to local weather forecasts, current ambient air conditions and loss in order to provide logical control signals that will optimize the use of heating and cooling cycles in a whole-building heating and cooling system for improved energy efficiency.

And yet another embodiment of the present invention is to provide a user-programmable controller having mathematical algorithms that computes building heat-loss models in order to provide modified algorithms for an improved overall energy efficiency of a programmable HVAC system by reactive evaluation of local weather forecasts, current ambient air conditions and models of building heat retention and loss in different environmental conditions.

Yet another embodiment of the present invention is to provide an upgradeable system of optimized HVAC control based on any combination of models and algorithms based on local weather forecasts, current ambient air conditions and models of building heat retention and loss. Users can introduce optimized control initially with only heating and cooling capability, but later add fresh air ventilation capability using the same system controller.

Still further objects and advantages will become apparent to those skilled in the art from a consideration of the entire disclosure provided herein, including the accompanying drawings and appended claims. Accordingly, departures in form and detail may be made without departing from the scope and spirit of the present invention herein described in the appended claims.

Thus any call for heating or cooling is first made by the first array of switched relays, whilst the second array of switched relays determines whether that call is directed to HVAC or FAV. The gray shaded switch relays are switched on when the temperature falls below the set point. All other switch relays are switched on when the temperature rises above the set point. The controller incorporates the following devices: 29. Connection Block to HVAC and FAV System; 36. First Switch Relay Array (Controlled by Inside Sensor); 37. Second Flip-Flop (Two-Way) Switch Relay Array (Controlled by Outside Sensor).

Figure 10:
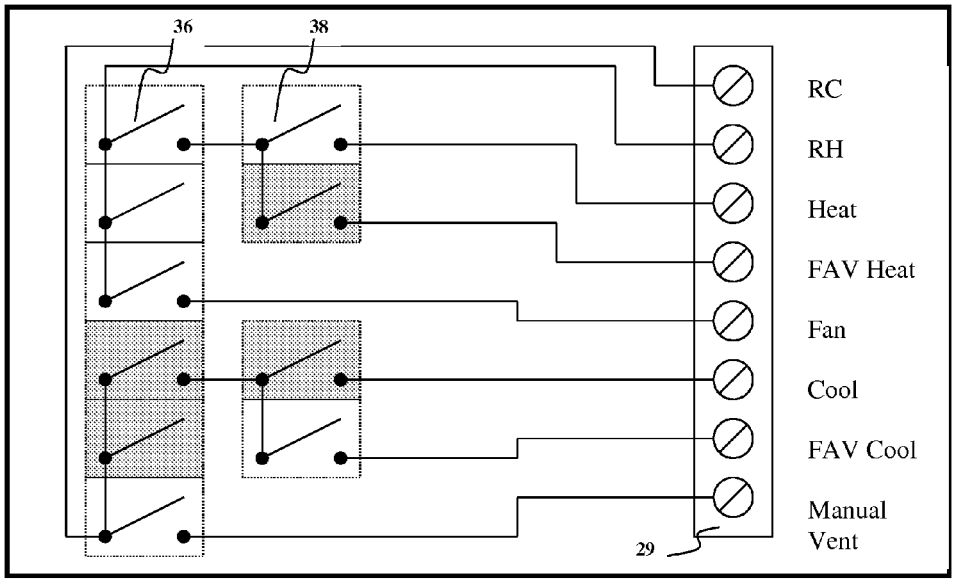

FIG. 10 provides a schematic wiring diagram of a Smart-Stat controller with a second array of relay switches wherein the second array of switches are conventional switch relays. The second switch relays permit a call to either HVAC without a call to FAV, or alternatively permit a call to FAV without a call to HVAC. The first array of switch relays are all switched by control signals derived from an inside temperature sensor, whilst the second array of switch relays is controlled by signals from an outside temperature sensor and weather monitor. Control signals to HVAC or FAV are only provided from the second array of switched relays. Thus any call for heating or cooling is first made by the first array of switched relays, whilst the second array of switched relays determines whether that call is directed to HVAC or FAV. The gray shaded switch relays are switched on when the temperature falls below the set point. All other switch relays are switched on when the temperature rises above the set point. The controller incorporates the following devices: 29. Connection Block to HVAC and FAV System; 36. First Switch Relay Array (Controlled by Inside Sensor); 38. Second Switch Relay Array (Controlled by Outside Sensor).

DETAILED DESCRIPTION OF THE PREFERRED EMBODIMENTS OF THE INVENTION

Figure 1:
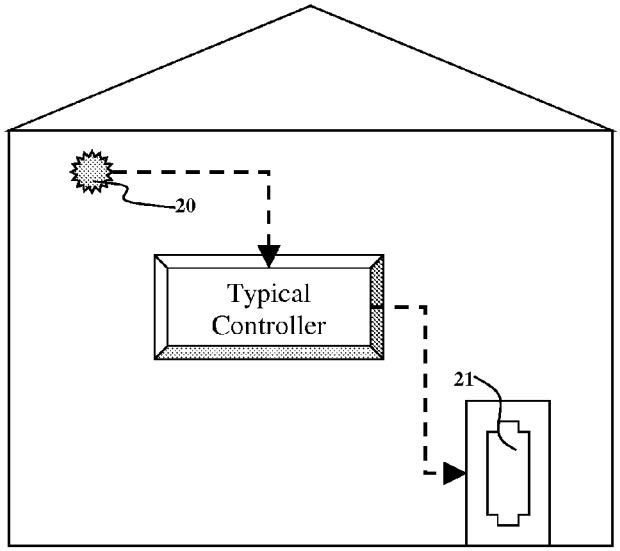
FIG. 1 provides a schematic of a typical building that includes a heating and cooling system that includes heating and cooling devices, heat exchangers, fans, ductwork and dampers. The controller incorporates the following devices: 20. Inside Temperature Sensors; 21. HVAC System.
Figure 2:
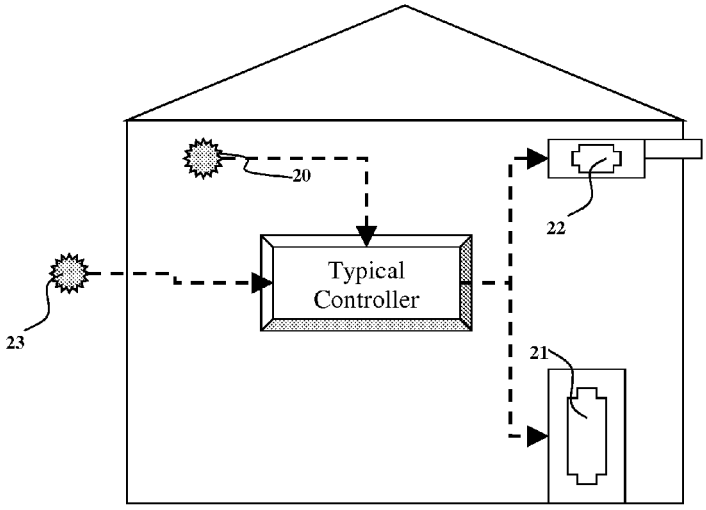
FIG. 2 provides a schematic of a non-typical building that includes a heating and cooling system similar to that shown in FIG. 1 but with the additional capability of fresh air ventilation (FAV) using a selectively operable damper and fan. The controller incorporates the following devices: 20. Inside Temperature Sensors; 21. HVAC System; 22. Ventilation System allowing outside air intake into house; 23. Outside Temperature and Humidity Sensors.
Figure 3:
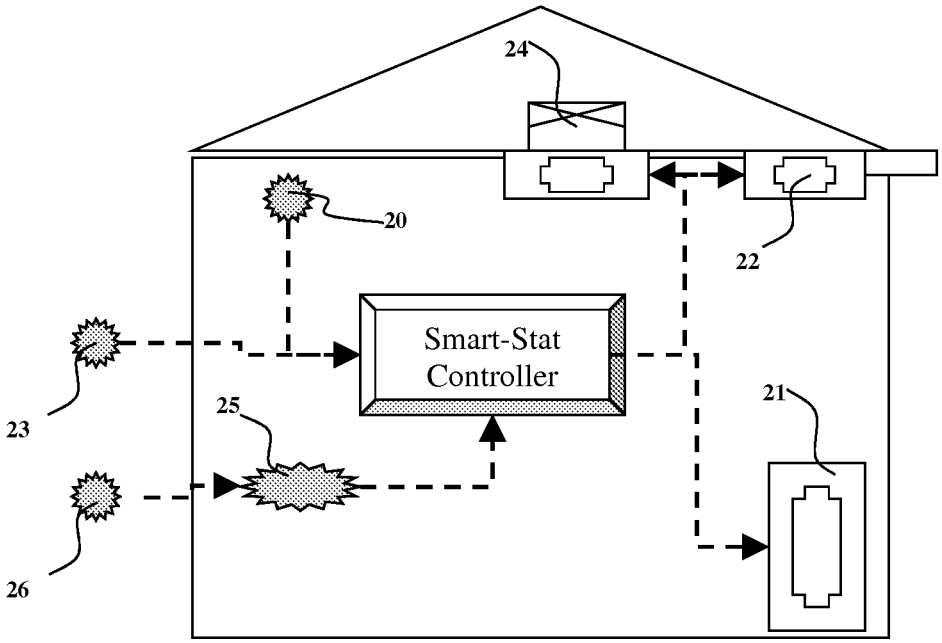
FIG. 3 provides a schematic of a Smart-Stat building that includes a heating and cooling system similar to that shown in FIG. 2 but with the additional capability of incorporating the presently claimed invention. The controller incorporates the following devices: 20. Inside Temperature Sensors; 21. HVAC System; 22. Ventilation System allowing outside air intake into house; 23. Outside Temperature and Humidity Sensors; 24. Ventilation Fan venting outside house; 25. Weather Data Interface (eg. WiFi) to Internet; 26. National Digital Forecast Database.
Figure 4:
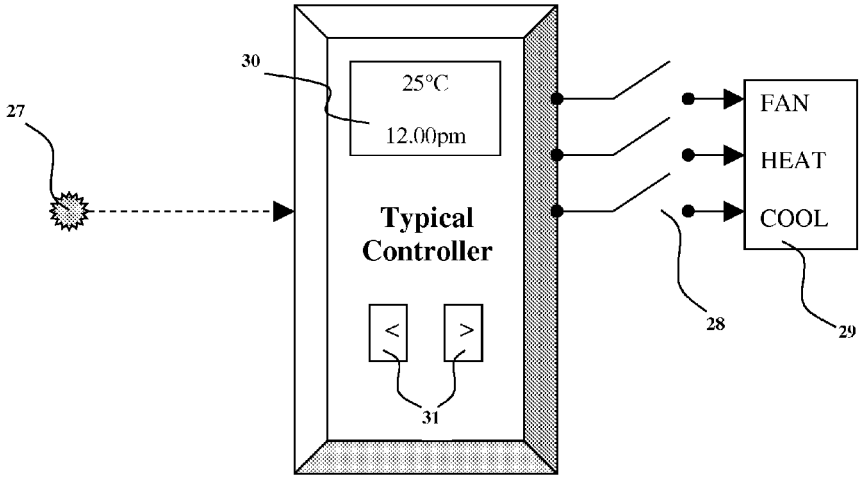
FIG. 4 provides a schematic of a typical thermostat controller that includes temperature inputs and controls the HVAC by calling on the Fan (FAN) for air distribution, Heat (HEAT) for heating or Compressor (COOL) for cooling. The controller incorporates the following devices: 27. Inside Temperature Sensors providing input to Controller; 28. Single Set of Output Relays; 29. Connection Block to HVAC System; 30. Display System (eg. LCD) of Controller; 31. Control Buttons on Controller.

The following detailed description should be read with reference to the drawings. The drawings are not to scale and depict illustrative examples and embodiments and are not intended to limit the scope of the present invention. A typical building is presented schematically in FIG. 1 and a building incorporating a ventilation system is presented schematically in FIG. 2. A building incorporating the Smart-Stat controller is presented schematically in FIG. 3. Typical controllers are presented schematically in FIG. 4, with controllers incorporating Smart-Stat presented schematically in FIG. 5 and FIG. 6.

Figure 5:
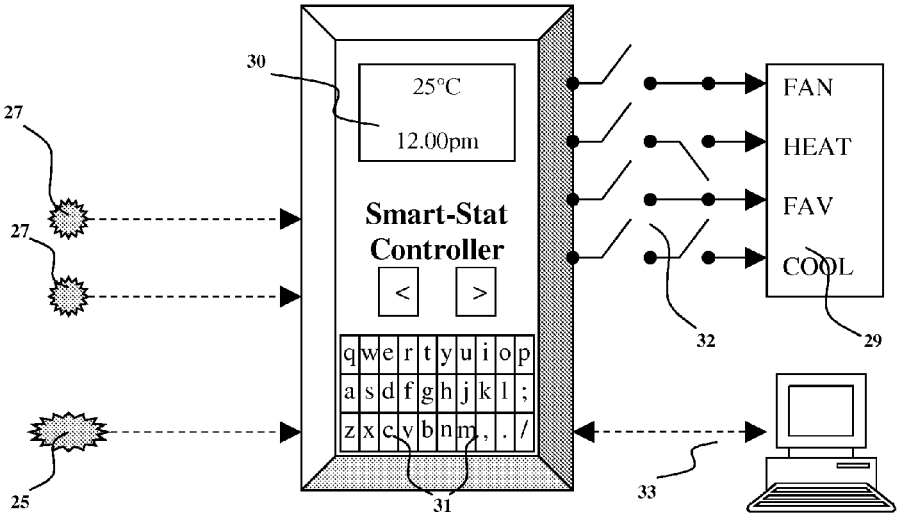
FIG. 5 provides a schematic of a Smart-Stat Controller that includes multiple temperature inputs as well as an interface with a weather forecasting database and controls the HVAC by calling on the Fan (FAN) for air distribution, Heat (HEAT) for heating or Compressor (COOL) for cooling and additionally has the capability of redirecting the call for heating or cooling by calling on Ventilation (FAV) for outside air cooling or heating. The controller incorporates the following devices: 25. Weather Data Interface (eg. WiFi) to Internet; 27. Inside Temperature Sensors providing input to Controller; 29. Connection Block to HVAC and FAV System; 30. Display System (eg. LCD) of Controller; 31. Control Buttons on Controller; 32. Double Set of Output Relays; 33. Computer Interface with Smart-Stat Controller.
Figure 6:
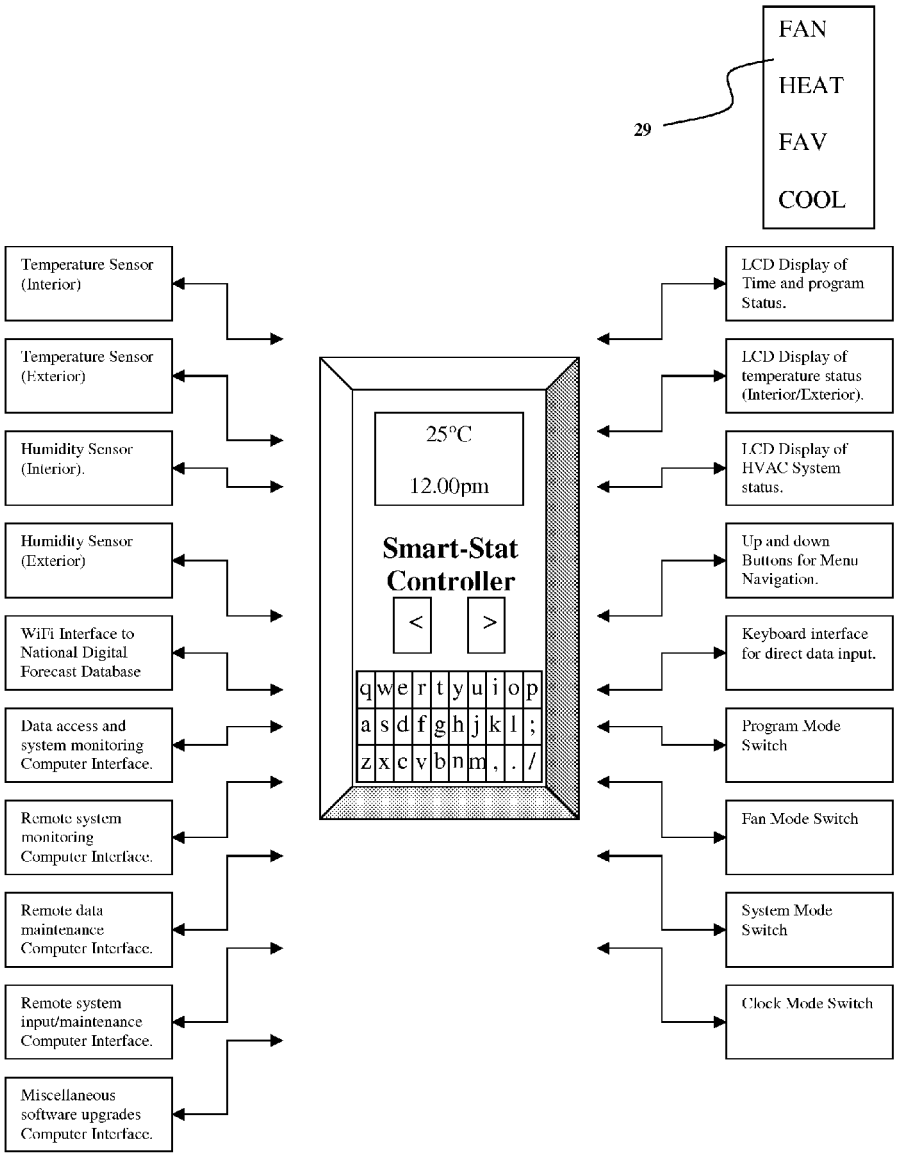
FIG. 6 provides an information model diagram of a Smart-Stat Controller as described in FIG. 5 wherein the controller controls the HVAC by calling on the Fan (FAN) for air distribution, Heat (HEAT) for heating or Compressor (COOL) for cooling and additionally has the capability of redirecting the call for heating or cooling by calling on Ventilation (FAV) for outside air cooling or heating. The controller incorporates the following device: 29. Connection Block to HVAC or FAV System.
Figure 7:
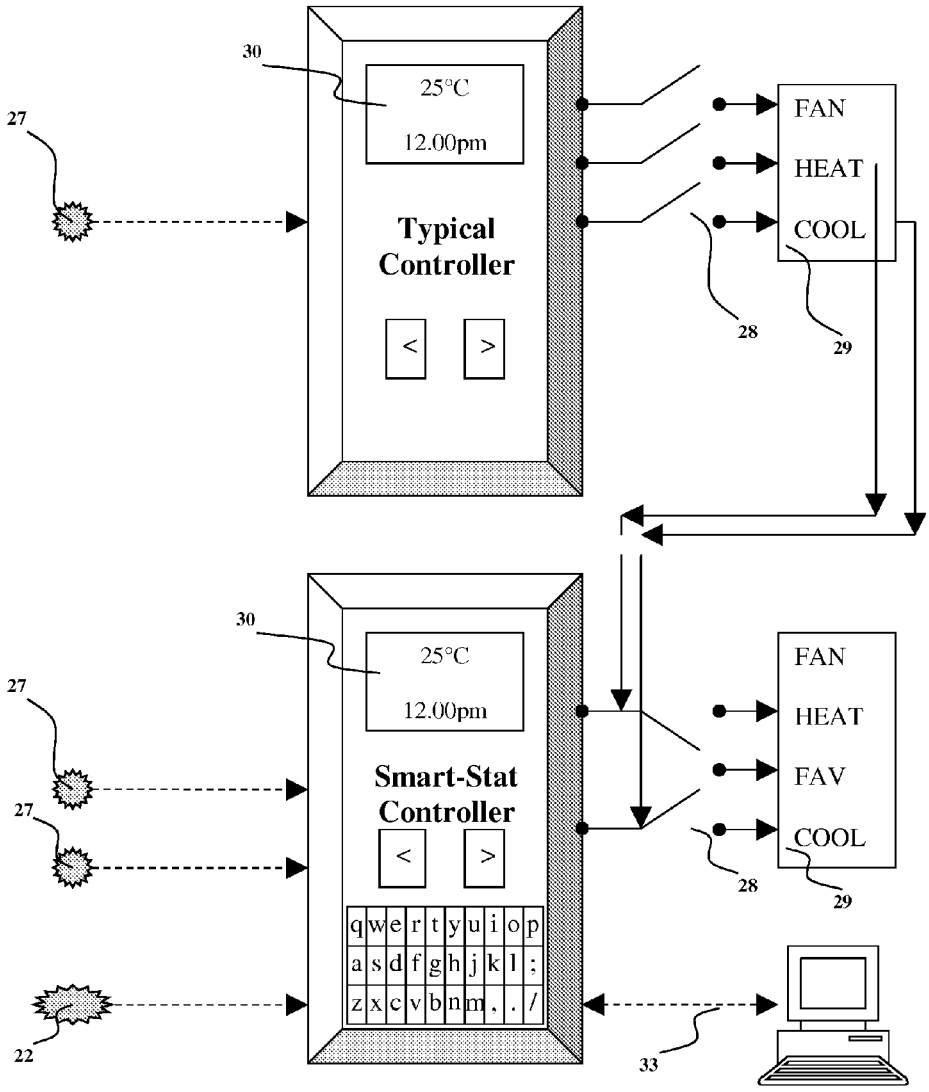
FIG. 7 provides a schematic of a typical thermostat controller as described in FIG. 4 working in conjunction with a Smart-Stat Controller as described in FIG. 5 wherein the typical controller calls for the Fan (FAN) for air distribution, Heat (HEAT) for heating or Compressor (COOL) for cooling and the Smart-Stat controller adds the functionality of redirecting the call for heating or cooling by calling on Ventilation (FAV) for outside air cooling or heating or permitting the system to call for Fan (FAN) for air distribution, Heat (HEAT) for heating or Compressor (COOL) for cooling. The controller incorporates the following devices: 22. Weather Data Interface (eg. WiFi) to Internet; 27. Inside Temperature Sensors providing input to Controller; 28. Single Set of Output Relays; 29. Connection Block to HVAC or FAV System; 30. Display System (eg. LCD) of Controller; 33. Computer Interface with Smart-Stat Controller.
Figure 8:
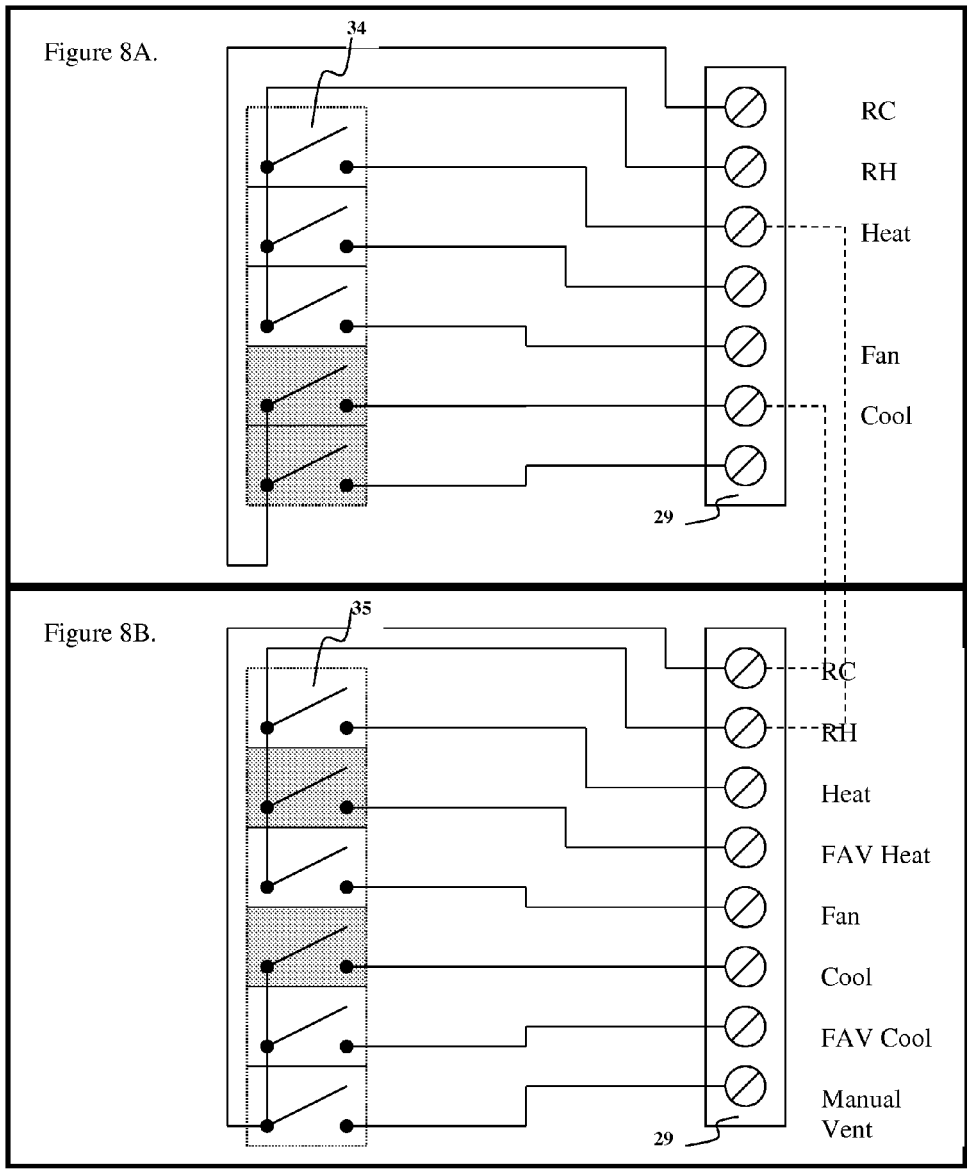
FIGS. 8A-8B provide a schematic wiring diagram of a typical thermostat controller working in conjunction with a Smart-Stat Controller. The first (FIG. 8A) controller functions with switch relays that are all switched by control signals derived from an inside temperature sensor. The second (FIG. 8B) Smart-Stat controller functions with switch relays that are all switched by control signals derived from an outside temperature sensor. The second controller is hardwired to the first controller so that control signals to HVAC or fan FAV are only provided from the second controller. The gray shaded switch relays are switched on when the temperature falls below the set point. All other switch relays are switched on when the temperature rises above the set point. The controller incorporates the following devices: 29. Connection Block to HVAC or FAV System; 34. Typical Switch Relay Array (Controlled by Inside Sensor); 35. Second Switch Relay Array (Controlled by Outside Sensor).
Figure 9:
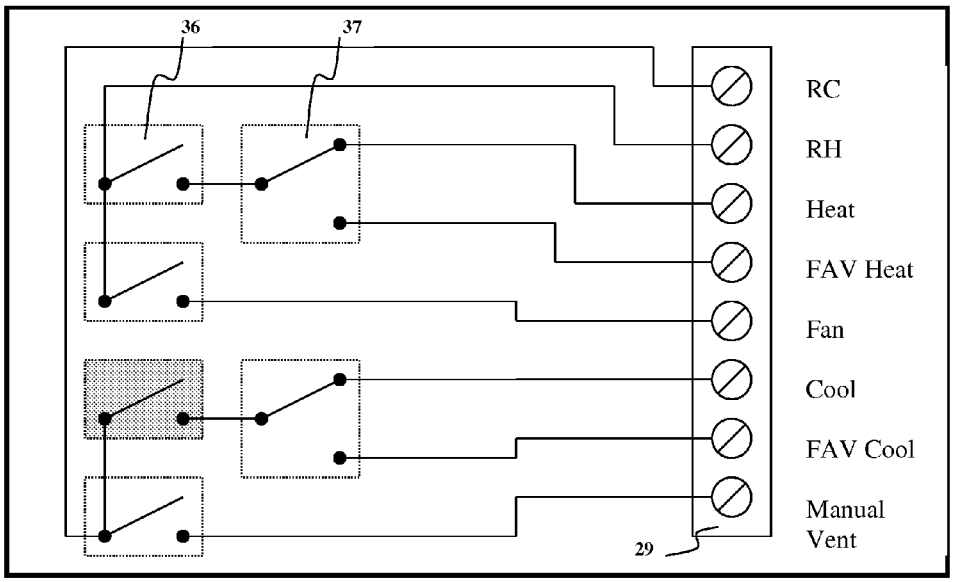
FIG. 9 provides a schematic wiring diagram of a Smart-Stat controller with a second array of switch relays wherein the second array are "flip-flop" (two way) switches, permitting a call to either the HVAC or FAV. The first array of switch relays are all switched by control signals derived from an inside temperature sensor, whilst the second array of switch relays is controlled by signals from an outside temperature sensor and weather monitor. Control signals to HVAC or FAV are only provided from the second array of switched relays.

The present invention is directed to mathematical algorithms incorporated into a controller 20 shown schematically in FIG. 5 and a method of determining control signals that are dependent on said mathematical algorithms and user programming that integrates information from multiple sensors 21, thermostats as well as weather information 22. Used in any home or building, the controller controls heating, cooling and ventilation systems in order to reduce costs and the carbon footprint of said heating and cooling by optimizing the use of fresh air ventilation. The controller works with typical HVAC systems generally in buildings and homes.

In addition to the controller and its mathematical set-point algorithms, the system requires that the house has appropriate outside ventilation capability. This requires installation of an outside vent as well as ducting, filters, dampers and suitable vent fans and additionally requires a balanced ventilation capability where the volume of air taken inside the building is balanced by a similar volume of air vented outside of the building. Typically, fans use less than 10% of the energy of a typical HVAC system calling on Heating or Cooling. Thus the present invention can in certain circumstances reduce the energy consumed to heat and cool buildings.

The Smart-Stat algorithms are programmed into the controller and enable the controller to identify user-determined set-points alongside data from one or multiple internal temperature sensors. The user-determined set-points are also linked to time of day and day of week in a manner similar to typical thermostat devices available today. In such typical thermostat devices the controller will call for cooling or heating depending on the set points and conditions determined by the sensors in the building. The present invention is capable of interrupting the call for cooling or heating depending on whether the mathematical algorithms identify suitable outside weather conditions that permit the use of outside air cooling or outside air heating. Thus the call for heating or cooling can be redirected by the present invention in order to call for ventilation instead of heating or cooling.

The Smart-Stat controller includes a digital display system and digital keypad that acts as a user-interface for immediately adjusting set-points and timing of set-points. The timing can be time of day as well as day of week. The system can also interface with a computer for more refined control setting and linking with building automation software systems. The Smart-Stat is also capable of displaying information on HVAC performance over time and specifically can display the Heat transfer coefficient (U-value) of the building comparing this with a database of similar buildings. Specifically the Smart-Stat can inform the user of the building's relatively poor, average or good performance in terms of heat transfer. This information could be used by the user to make decisions about installing additional insulation or having a more rigorous home survey of insulation or draftproofing.

EXAMPLES

Having generally described this invention, including methods of making and using the novel compositions and the best mode thereof, the following examples are provided to extend the written description and enabling disclosure. However, those skilled in the art will appreciate from this disclosure that the invention may be varied in accordance with the disclosure and guidance provided herein, without departing from the heart of the invention. Further, the specifics provided in the examples below should not be construed as limiting. Rather, for an appreciation of the scope of the invention comprehended by this disclosure, reference rather should be had to the appended claims and their equivalents.

Example 1

A whole-house fan (e.g., a typical direct-drive or belt-drive and thermally-protected fan is obtained DIY suppliers) was modified to fit an insulated opening in the ceiling of a conventional insulated two-story timber-framed house. The fan is controlled manually by a hand-held switch and used in conjunction with open or closed windows. The fan is conventional, multi-speed, 3-bladed and capable of blowing air at more than 1,000 cubic feet per minute. By controlling the fan in different environmental conditions throughout the year, we determined that outside air is an effective way of cooling a house when outside temperature and humidity is suitable. The system was not very effective when windows were partially closed and almost completely ineffective when windows were completely closed.

Example 2

Daily maximum and minimum temperature data as well as hourly temperature data for different cities and states were downloaded from publicly available databases (e.g., Iowa Environmental Mesonet). These data were from different years such as 2000, 2001, 2002, 2003, 2004, 2005, 2006, 2007. A computer modeling spreadsheet was devised to evaluate and compare the costs of using a conventional thermostat controller compared with the present invention. The modeling system was also evaluative, allowing different methods of control and different set-points to be evaluated. Using this system we found that energy savings of up to 25% were possible on certain times of day and on different days energy savings of an extra 15% were possible. Savings were not possible on all days of the year but in no case was the present invention less efficient when compared with our model of a conventional thermostatic controller.

We concluded that the present invention has the potential to decrease energy costs of heating and cooling over a period of time and over the years. With a saving of 10-20% in energy costs the Smart-Stat controller quickly recovers the added costs of investment. Most importantly the present invention presented essentially no risk of increasing costs over a prolonged period of use.

Example 3

Thermal heat loss equations (see table below) can be calculated based on Heat Loss equations (Simplified design of HVAC systems. William Bobenhausen, 1994, Technology & Engineering) or U-factors (quantified as BTU/ft$^{2}$° F.hr). Using information provided in chapter 5 we computed the U-factor for different rooms by using the published BTU/° F.hr. There was considerable variation between rooms even in the same house (ranging from 0.1 to 0.3 BTU/sq.ft.° F.hr). It is obvious that the range of variation in thermal loss values will be even greater between different houses.

| | Heat Loss (BTU/° F. hr) | Surface Area (sq. ft) | Thermal Loss (UA) (BTU/sq. ft. ° F. hr) |
|---|---|---|---|
| Room A (15 × 10 × 10) | 46.3 | 150 | 0.309 |
| Room B (15 × 20 × 10) | 55 | 300 | 0.183 |
| Room C (10 × 10 × 10) | 9.7 | 100 | 0.097 |
| Room D (15 × 15 × 10) | 63.3 | 225 | 0.281 |
| Room E (10 × 15 × 10) | 40 | 150 | 0.267 |
| Room F (6 × 15 × 10) | 14 | 90 | 0.156 |
| Room G (12 × 15 × 10) | 23.4 | 180 | 0.130 |
| Room H (9 × 15 × 10) | 26.6 | 135 | 0.197 |
| Total/Average | 34.9 | 1330 | 0.203 |

Building Thermal heat loss equation: ($QA = U \cdot A \cdot (T_i - T_a)$)
Q = Total hourly rate of heat loss (Btu/hr) as measured for each building.
U = Heat transfer coefficient (Btu/hr-sqft-° F.) can be determined for each building.
A = Net area for heat transfer (sq. ft) measured on the drawing/building.
Ti = Inside design temperature (° F.) preset on thermostat (eg. 68° F.).
Ta = Outside design temperature (° F.) depends on outside temperatures.

Some houses show significantly worse performance than others which can later be shown to be due to poorer insulation or older insulation materials that had settled and hence were less effective. These data reveal the value of a Smart-Stat monitoring device that quantifies heat loss in a given house relative to outside temperatures when heating has terminated. This house-specific U-factor permits then an estimate of the house-specific coefficient of heat loss and answers the question of whether a particular house is relatively better or worse than another in terms of heat loss. Such heat-loss monitoring data is not only valuable in a smart thermostat for each specific house. Thus for example the data can be used as a source of guidance for house owners and in a database by professionals leading to potentially significant energy savings by pointing to improvements in insulation for a given house.

Example 4

A prototype of the Smart-Stat system is currently programmed into a PIC 18 chip from Microchip Technology Inc. One example used the PIC18F4XK20 Starter Kit. Any programmable microcontroller device from any manufacturer may be used with the envisioned software protocols claimed herein provided sufficient processing capability exists. For example, the PIC 18, PIC 24 and PIC 32 architecture microprocessor from Microchip are sufficient. The device can be programmed using the Microchip MPLAB C Compiler. The microprocessor must have a real time clock, standard on many PIC controllers. The thermostat consists of two components: the controller that mounts near the air handling equipment and the wall-mounted microprocessor-controlled display unit, allowing temperature control via several methods. Locally, simply push the buttons on the wall-mounted unit's thermostat-like user interface. Remote or automated control is via RS-232/485 remote interfaces, making adjustments from the RS-232/485 home control system. The thermostat unit controls all standard functions of gas/electric or heat-pump HVAC systems, including heating (two-stage heating on heat-pump systems), cooling and fan control. It connects to HVAC systems via standard thermostat connections, and connects to the wall-display unit via a 4-wire connection (2 power, 2 data). The controller also offers fuse-protected relay outputs to the mechanical system, responds to polling requests by sending current temperature, set-point, mode and fan status.

The programmable microprocessor contains multiple subroutines that control the fans, call for heating or cooling or ventilation and also allow the user to change set points and time variables in the microcontroller. The control interface utilizes relay devices to handle the electrical load required for HVAC control. Although these connections are essential to the functionality of the microcontroller interface with the HVAC these connections are well known in the art and need not be described in detail herein.

What is important is the fundamental concept of using ambient air as a source of heating and cooling as well as the algorithms that determine when the system calls for heating or cooling or ventilation. It is of course these algorithms programmed into the Smart-Stat microcontroller that saves on energy use and costs. The algorithms and subroutines that interface with temperature and humidity sensors and weather-data are described in the following examples.

Example 5

The temperature sensor and humidity sensor subroutines required to function with the Smart-Stat programmable microprocessor allow a different choice than using energy to heat or cool. Temperatures are in degrees Fahrenheit (F).

During a HEATING CYCLE there is a cascade of logical on/off decisions determined by the Smart-Stat controller as follows (also shown in table below):

1. Controller stays INACTIVE when temperature inside building is above set-point, causing controller not to call for heating. Since cooling is inactive the controller will not call for cooling.
2. Controller calls for HEAT when temperature inside building is below set-point. Controller permits HEAT provided VENT not activated by outside temperature or weather data decision point.

3. Controller calls for VENT when temperature outside is above temperature inside building and humidity is within set-points limits. This call for VENT over-rides the call for heating.
4. Controller calls for VENT when temperature outside is forecast to be above temperature inside building within a period of time set by the user or set by the controller using its calculation of the heat-loss coefficient of the building. This call for VENT over-rides the call for heating and is also determined by the humidity set-point limits.
5. Controller calls for HEAT when temperature inside building is below a minimum temperature that is considered a risk in terms of freezing water. This call for HEAT by the controller over-rides all other set-points derived from sensors or weather data and closes all dampers and vents associated with the ventilation system.

| HEATING CYCLE | | Set Point | Inside Sensor | Outside Sensor | Outcome |
|---|---|---|---|---|---|
| Cold inside, | Temperature | 70 F. | 65 F. | 75 F. | — |
| Warm outside | Switch On/Off. | — | On | On | Heat-Vent |
| Cold inside, | Temperature | 70 F. | 65 F. | 65 F. | — |
| Cold outside | Switch On/Off. | — | On | Off. | Heat-HVAC |
| Warm inside, | Temperature | 70 F. | 75 F. | 65 F. | — |
| Cold outside | Switch On/Off. | — | Off. | On | Zero |
| Warm inside, | Temperature | 70 F. | 75 F. | 75 F. | — |
| Warm outside | Switch On/Off. | — | Off. | Off. | Zero |

During a COOLING CYCLE there is a cascade of logical on/off decisions determined by the Smart-Stat controller as follows (also shown in table below):

1. Controller stays INACTIVE when temperature inside building is below set-point, causing controller not to call for cooling. Since heating is inactive the controller will not call for heating.
2. Controller calls for COOL when temperature inside building is above set-point. Controller permits COOL provided VENT not activated by outside temperature or weather data decision point.
3. Controller calls for VENT when temperature outside is below temperature inside building and humidity is within set-points limits. This call for VENT over-rides the call for cooling.
4. Controller calls for VENT when temperature outside is forecast to be below temperature inside building within a period of time set by the user or set by the controller using its calculation of the heat-gain coefficient of the building. This call for VENT over-rides the call for cooling and is also determined by the humidity set-point limits.

| COOLING CYCLE | | Set Point | Inside Sensor | Outside Sensor | Outcome |
|---|---|---|---|---|---|
| Warm inside, | Temperature | 80 F. | 85 F. | 75 F. | — |
| Cold outside | Switch On/Off | — | On | On | Cool-Vent |
| Warm inside, | Temperature | 80 F. | 85 F. | 85 F. | — |
| Warm outside | Switch On/Off | — | On | Off | Cool-HVAC |
| Cold inside, | Temperature | 80 F. | 75 F. | 85 F. | — |
| Warm outside | Switch On/Off | — | Off | On | Zero |
| Cold inside, | Temperature | 80 F. | 75 F. | 75 F. | — |
| Cold outside | Switch On/Off | — | Off | Off | Zero |

Example 6

The weather-data subroutines required to function with the Smart-Stat programmable microprocessor.

Example 7

The Smart-Stat system may also be configured to work with for example an RCS Model TXB16 X10 Bi-Directional HVAC Thermostat using X10 communication via power lines, or Model TR16 Communicating Thermostat using RS485 data communication via standard serial ports. However, any HVAC system can be configured to be controlled by the current invention as any simple controller system having an appropriate interface and appropriate switching system is all that is required. A stand-alone Smart-Stat controller unit can also be envisioned, similar in outside appearance to those available today from many stores. Such a stand-alone controller can be custom designed to incorporate all of the required control features and computing algorithms and be configured with WiFi capability so as to interface with home computer systems.

Example 8

The Smart-Stat system uses computerized control and mathematical algorithms to interface with the Communicating Thermostat and is time-based and day-based but is also linked to Weather data and an algorithm that learns heat loss and heat gain for the building. First and primary control is taken by a freeze-protection system that activates heating if temperatures fall below a preset temperature (eg., 50° F.). This building protection setting over-rides all other settings. During times requiring heat, the system calls for heating based on temperature sensors in the house and user-set temperature settings linked to time of day and day of week. The call for heating is interruptible by the Smart-Stat based on weather information and learned information about heat loss and gain that is specific to the building. During times requiring cool, the system calls for cooling based on temperature sensors in the house and user-set temperature settings linked to time of day and day of week. The call for cooling is interruptible by the Smart-Stat based on weather information and learned information about heat loss and gain that is specific to the building. The whole system is programmable from a touchpad display as well as by being able to interface with a computer using WiFi or is hard-wired. The Smart-Stat is also capable of switching on outside air ventilation in place of cooling or heating, depending on the outside temperature and humidity sensors and weather data.

What is claimed is:

1. A controller that integrates the control of heating or cooling in buildings by simultaneously controlling heating ventilation and cooling (HVAC) systems in concert with separate fresh air ventilation (FAV) systems by reacting to outside and inside conditions, wherein said controller comprises:

a. an internal sensor that monitors temperature in a building,
b. an outside sensor that monitors current outside air temperature,
c. a microprocessor system that sets logical set-points based on mathematical algorithms that uses said internal and outside sensors,
d. a user-programmable interface to said microprocessor system that enables a user to define time-based temperature set-points for improved comfort in the building, e. a first switch relay controlled by said microprocessor system and said internal sensor and providing output based on the temperature of the building monitored by said internal sensor, and f. a second switch relay in series with the first switch relay, controlled by said microprocessor system and said outside sensor, and receiving the output from the first switch relay, wherein the second switch relay determines whether calls for cooling or heating are diverted to said separate FAV or HVAC systems based on the output from the first switch relay and the current outside air temperature monitored by the said outside sensor.

2. A controller as described in claim 1 wherein said controller additionally utilizes a local weather forecasting data retrieval system provided over an internet connection wherein said controller uses weather forecasting data from the local weather forecasting data retrieval system to optimize algorithms for improved set-points for FAV or HVAC control.

3. A controller as described in claim 2 wherein said controller additionally comprises an ability to compute heat-models of building heat loss or gain relative to inside and outside environmental conditions wherein said controller uses said computed heat-models and said weather forecasting data to optimize algorithms for improved set-points for FAV or HVAC control.

4. A controller as described in claim 2 wherein said controller additionally comprises a fresh air supply duct, housing at least one damper and a fan that determines air flow into the building based on control signals from the controller and said weather forecasting data.

5. A controller as described in claim 1 wherein said controller additionally comprises an ability to compute heat-models of building heat loss or gain relative to inside and outside environmental conditions wherein said controller uses said computed heat-models to optimize algorithms for improved set-points for FAV or HVAC control.

6. A controller as described in claim 5 wherein said controller additionally comprises a fresh air supply duct, housing at least one damper and a fan that determines air flow into the building based on control signals from the controller and said computed heat models.

7. A controller as described in claim 3 wherein said controller additionally comprises a fresh air supply duct, housing at least one damper and a fan that determines air flow into the building based on control signals from the controller, said weather forecasting data, and said computed heat models.

8. A controller as described in claim 1 wherein said controller additionally comprises a fresh air supply duct, housing at least one damper and a fan that determines air flow into the building based on control signals from the controller.

9. A controller as described in claim 8, 4, 6 or 7 wherein said controller additionally comprises a means of monitoring air flow rate in said duct so as to achieve a balance of air exhaust and intake.

10. A controller as described in claim 8, 4, 6 or 7 wherein said controller computes logical set-points based on one or more humidity sensors in the building and one or more outside air humidity sensors.

* * * * *